United States Patent [19]

Randolph

[11] 4,175,877

[45] Nov. 27, 1979

[54] RIBBON CARTRIDGE HAVING A CONVOLUTE-FORMING ROLLER

[75] Inventor: John E. Randolph, Palatine, Ill.

[73] Assignee: Teletype Corporation, Skokie, Ill.

[21] Appl. No.: 883,771

[22] Filed: Mar. 6, 1978

[51] Int. Cl.[2] ..... B41J 33/10

[52] U.S. Cl. ..... 400/196

[58] Field of Search ..... 400/124, 194, 195, 196, 400/196.1, 238, 242; 242/55.19 A

[56] References Cited

U.S. PATENT DOCUMENTS

| | | | |
|---|---|---|---|
| 1,947,019 | 2/1934 | Racz | 400/196 |
| 1,947,034 | 2/1934 | Butler | 400/196 |
| 2,818,155 | 12/1957 | Kizak | 400/238 |
| 3,982,622 | 9/1976 | Bellino et al. | 400/124 |
| 4,046,247 | 9/1977 | Laspesa et al. | 400/196 |

FOREIGN PATENT DOCUMENTS

| | | | |
|---|---|---|---|
| 681482 | 9/1939 | Fed. Rep. of Germany | 400/242 |

*Primary Examiner*—Ernest T. Wright, Jr.
*Attorney, Agent, or Firm*—W. K. Serp; J. C. Albrecht

[57] ABSTRACT

In a cartridge for an endless typewriter ribbon, a fresh ribbon is stored in the cartridge with a substantial length of ribbon wound in a convolute around a roller. When the cartridge is mounted in a printing apparatus, the ribbon is drawn from the cartridge, exhausting the convolute. When the cartridge is fully mounted in position in the printer, a single path of ribbon extends into the cartridge and through an opening along a chord of the roller and out from the cartridge. A brake is provided to limit motion of the roller so as to preclude premature unwinding of the convolute and to limit oscillation of the roller during operation of the printer. With the normal operating path of the ribbon extending through the chord-oriented slot of the roller, ribbon can readily be rewound onto the roller upon removal of the cartridge from the printer.

7 Claims, 3 Drawing Figures

RIBBON CARTRIDGE HAVING A CONVOLUTE-FORMING ROLLER

FIELD OF THE INVENTION

This invention relates to a ribbon cartridge and more particularly to a ribbon cartridge in which an endless ribbon is stored in a convolute about a roller. When unwound from the convolute in operation, the ribbon extends through a slot in the roller to facilitate rewinding.

BACKGROUND OF THE INVENTION

Printing machines such as that shown in U.S. Pat. No. 3,982,622 issued in the name of J. A. Bellino, et al., on Sept. 28, 1976, preferably employ inked ribbons which are supplied to users in cartridges. Such an inked-ribbon cartridge is disclosed in U.S. Pat. No. 4,046,247 granted to R. E. LaSpesa et al. on Sept. 6, 1977. In such a cartridge, the ribbon is wound into a convolute at the factory for storage within the cartridge during shipment and before installation in the printer. A small portion of the endless ribbon extends along one outside edge of the cartridge to facilitate looping of that portion over fixed guides in the printer. The cartridge is then drawn across the width of the printer. In this motion, the ribbon is drawn out of the convolute and is stretched taut across the width of the printer as the cartridge is mounted into position. All of the ribbon is withdrawn from the convolute; and the only ribbon remaining in the cartridge is that which extends in a single path into the cartridge, around a corner roller, and around a re-inking roller. In the LaSpesa et al. patent, the chamber of the cartridge in which the convolute is stored is completely empty by reason of withdrawal of the ribbon from the cartridge during insertion in the printer. Should the ribbon cartridge be removed from the printer prior to the end of the ribbon's useful life, there is no provision for easily rewinding the ribbon back into the cartridge; and the ribbon merely dangles limply from the cartridge posing a messy task if it is desired to remount the ribbon into the printer. Also, in manufacture of cartridges, the convolute must be formed prior to assembly and bonding of the cartridge cover. If some ribbon is inadvertently withdrawn from the cartridge during shipment or handling prior to installation, there is no way to rewind the ribbon into the cartridge. Consequently, the fastidious technique of ribbon mounting disclosed in the LaSpesa et al. patent is impaired by even partial premature unwinding of the ribbon.

SUMMARY OF THE INVENTION

The present invention relates to an improved ribbon cartridge of the type in which an endless ribbon is stored within a cartridge housing prior to use of the ribbon. The cartridge is mountable in an apparatus and at a location remote from a ribbon guide. Therefore, in the mounting operation, the ribbon is hooked over the ribbon guide, and the stored supply of ribbon is withdrawn from convoluted storage within the cartridge housing with ribbon being guided in operation through the housing. The improvement comprises a convolute-forming roller, a chord-oriented guide path in the roller through which the ribbon can pass in operation and means for limiting movement of the roller.

BRIEF DESCRIPTION OF THE DRAWING

A more complete understanding of the present invention may be had by referring to the following detailed description when considered in conjunction with the accompanying drawing wherein.

DETAILED DESCRIPTION

Figure 1:
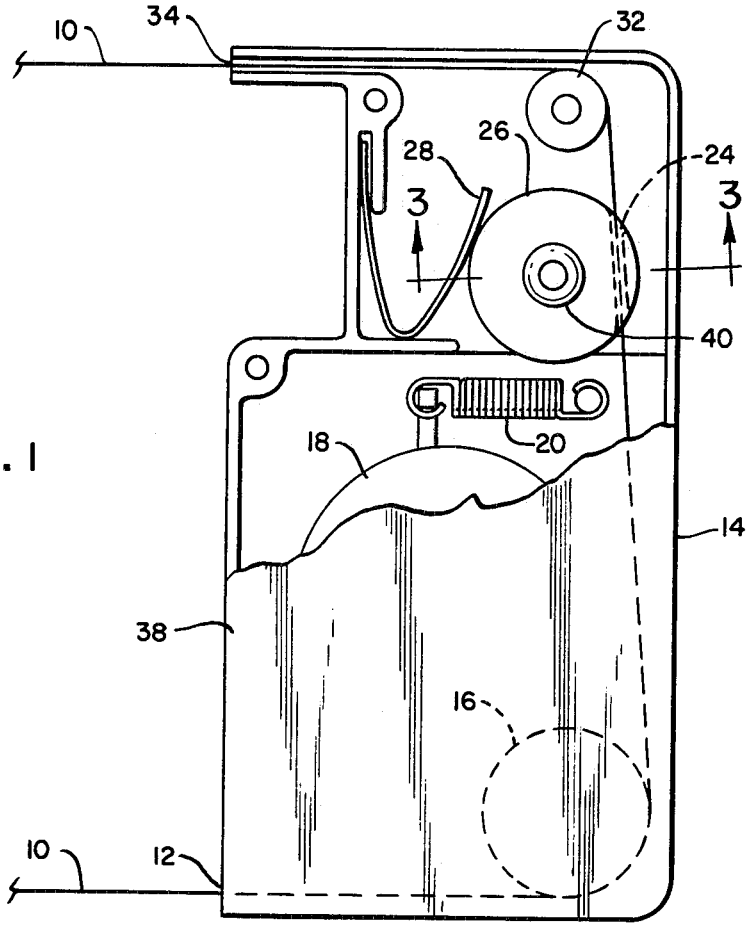
FIG. 1 is a partial cutaway view of a ribbon cartridge in accordance with the present invention showing the condition of the ribbon after the cartridge has been mounted in a printer.

Referring now to the accompanying drawing and more particularly to FIG. 1, a ribbon 10 is shown entering a cartridge 14 at its lower opening 12. As shown in dotted lines, the ribbon 10 extends around a re-inking roller 16 that is kept moistened with ink by a sponge or reservoir roller 18 that is biased by a spring 20 into engagement with the re-inking roller 16. The re-inking roller 16 is of a hard plastic material such as nylon and is mounted for rotation within the cartridge 14.

After the ribbon 10 passes around the re-inking roller 16, it passes through an opening or slot 24 that is arranged or oriented along a chord of a convolute-forming roller 26. The convolute-forming roller 26 is also mounted for rotation within the cartridge 14 but is frictionally held against spurious rotation by a friction spring 28 to prevent rotation of the roller 26 from misaligning the ribbon 10 and the opening 24 and thereby increasing the friction of the ribbon path or even binding and thus preventing free longitudinal movement of the ribbon 10 in its associated printing apparatus.

After passing through the opening 24, the ribbon 10 passes around a ribbon-bending guide member or roller 32 and then out through an upper opening 34 of the cartridge 14 to span the printing position of an associated printing apparatus.

Figure 3:
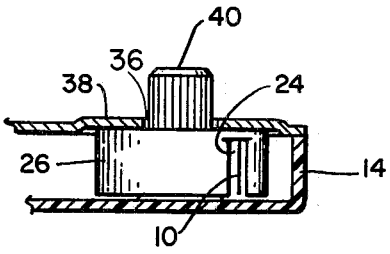
FIG. 3 is a cross-sectional view of the region of the rewind roller taken along line 3—3 of FIG. 1, showing the ribbon passing through a chord-oriented slot, forming a ribbon guide path through the roller.

The opening 24 in the roller 26 is shown in dotted lines in FIG. 1. A more accurate representation of the opening 24 is illustrated in the cross-sectional view labelled FIG. 3. In FIG. 3 the ribbon 10 is shown in end view passing through the opening 24 which is open downwardly within the roller 26 as viewed in FIG. 3. Because the opening 24 is substantially wider than the ribbon 10 and the roller 26 is rotatably positioned by the ribbon 10 as the cartridge 14 is mounted in its associated printing apparatus, the roller 26 adds substantially no friction to the path of the ribbon 10.

The cover 38, which is shown partially broken away in FIG. 1, is illustrated more fully in FIG. 3. A winding knob 40 which is an integral part of the roller 26 extends through an opening in the cover 38 to permit manual rotation of the roller 26 or machine rotation of the roller 26 during assembly of a new ribbon cartridge 14.

Figure 2:
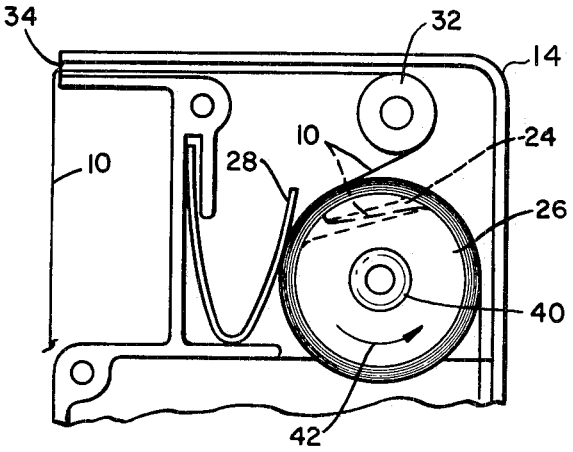
FIG. 2 is a partial view of the cutaway portion of FIG. 1 but with the ribbon shown in its convoluted condition prior to mounting of the cartridge in a printer.

Referring now to FIG. 2, the upper portion of the cartridge 14 shown in FIG. 1 is reproduced but showing the ribbon 10 wound in a convolute about the roller 26. This is accomplished by rotating the winding knob 40 in the counter-clockwise direction as indicated by the arrow 42 in FIG. 2. This is the condition in which the cartridge 14 may be most easily shipped, handled and assembled into a printer. The spring 28 prevents spurious rotation of the roller 26 and thus prevents ready unwinding of the convolute of ribbon 10 except when a definite force is applied to the ribbon 10 outside of the cartridge 14 in order to pull ribbon 10 out of the openings 12 and 34. During mounting of the ribbon cartridge 14 into a printer, the roller 26 is caused by the extracting ribbon 10 to rotate in the clockwise direction as viewed in FIG. 2 against the friction generated by the spring 28.

While one specific embodiment and example of the invention have been described in detail above, it will be obvious that various modifications may be made from the specific details described, without departing from the spirit and scope of the invention.

What is claimed is:

1. An improved ribbon cartridge of the type in which an endless ribbon is stored within a cartridge housing prior to use of the ribbon, the cartridge being mountable in an apparatus so that in the mounting operation the ribbon is withdrawn from a convoluted storage within the cartridge housing and is guided in operation through the cartridge housing, wherein the improvement comprises:

a convolute-forming roller rotatably mounted in the cartridge;

a chord-oriented guide path in the roller through which the ribbon passes in operation; and means for limiting extraneous rotation of the roller.

2. A ribbon cartridge according to claim 1 further including at least one ribbon-bending guide member located and oriented to bend the ribbon from a line through the chord-oriented guide path to a path that extends out of the cartridge.

3. A ribbon cartridge according to claim 2 wherein the ribbon bending guide member has at least one tangent oriented to pass through the chord-oriented guide path of the roller when the cartridge is mounted for operation in a printer.

4. A ribbon cartridge according to claim 1 wherein the means for limiting extraneous rotation of the roller comprising a flexure spring biased to exert a force upon the periphery of the convolute-forming roller.

5. A ribbon cartridge according to claim 1 wherein the convolute-forming roller further comprising a winding knob mounted coaxially with the convolute-forming roller for rigid rotation therewith.

6. A ribbon cartridge according to claim 1 including a winding knob securely mounted upon said convolute-forming roller, said winding knob having a diameter smaller than the diameter of said convolute-forming roller, said cartridge further having a cover with an opening therein smaller than the diameter of the convolute-forming roller but larger than the diameter of the winding knob and through which the winding knob extends.

7. A ribbon cartridge according to claim 1 or 5, wherein the convolute-forming roller is substantially solid and wherein the chord-oriented guide path comprises a slot formed at least part way through the axial dimension of the convolute-forming roller by extending along a chord displaced from the axis of the convolute forming roller; said slot being open to one side of the roller opposite to the winding knob.

* * * * *